US012768088B2

(12) United States Patent
Boquet

(10) Patent No.: US 12,768,088 B2
(45) Date of Patent: Oct. 20, 2026

(54) APPARATUS AND METHODS FOR PIECING A MATERIAL TO FORM A QUILT

(71) Applicant: Daneá Boquet, Boerne, TX (US)

(72) Inventor: Daneá Boquet, Boerne, TX (US)

( * ) Notice: Subject to any disclaimer, the term of this patent is extended or adjusted under 35 U.S.C. 154(b) by 57 days.

(21) Appl. No.: 18/388,887

(22) Filed: Nov. 13, 2023

(65) Prior Publication Data

US 2025/0154717 A1 May 15, 2025

(51) Int. Cl.
*D05B 97/12* (2006.01)
*D05B 93/00* (2006.01)

(52) U.S. Cl.
CPC ..... *D05B 97/12* (2013.01); *D05B 93/00* (2013.01); *D05D 2305/24* (2013.01)

(58) Field of Classification Search
CPC ..... D05B 97/02; D05B 97/12; D05B 97/00; D05B 93/00; D05B 95/00; A41H 3/08; A41H 3/06
See application file for complete search history.

(56) References Cited

U.S. PATENT DOCUMENTS 4,244,996 A * 1/1981 Maloney ..... B44F 11/00 156/196
4,646,666 A * 3/1987 Burrier ..... B44C 3/12 112/475.08
5,749,149 A * 5/1998 Claytor ..... B26B 29/06 33/1 G
6,021,726 A * 2/2000 Muraki ..... B44C 3/12 112/117
6,263,816 B1 7/2001 Codos et al.
7,448,142 B2 * 11/2008 Geier ..... D05B 91/06 112/475.08
7,854,073 B1 * 12/2010 Webb ..... D05B 97/12 33/1 G
8,689,711 B1 * 4/2014 Grover ..... D05B 11/00 112/475.08
10,561,186 B2 * 2/2020 Feliu De La Pena Calvo ..... D05B 97/12
2007/0199466 A1 * 8/2007 Franz ..... D06P 5/30 101/485
2009/0038521 A1 * 2/2009 Allen ..... D05C 1/08 112/400

OTHER PUBLICATIONS

Quiltsmart Grid Interfacing; https://missouriquiltco.com/products/quiltsmart-2-grid-interfacing; Aug. 1, 2023.

* cited by examiner

*Primary Examiner* — Danny Worrell
(74) *Attorney, Agent, or Firm* — David W. Carstens; Stephanie E. Scoggin; Carstens, Allen & Gourley, LLP

(57) ABSTRACT

A method of texturing fabric to produce a surface of a quilt. The method includes folding down the fabric top along a marking of a first set of markings to produce a fold and sewing a seam along the fold, repeating the folding and sewing steps for each marking of the first set of markings. After folding and sewing, the method can include cutting a portion of each fold where the seam associated with the first set of markings intersects with the other set of markings. The method can include folding down the fabric top along a marking of a second set of markings to produce a fold and sewing a seam along the fold, repeating the folding and sewing steps for each marking of the second set of markings.

12 Claims, 4 Drawing Sheets

APPARATUS AND METHODS FOR PIECING A MATERIAL TO FORM A QUILT

CROSS-REFERENCE TO RELATED APPLICATIONS

Not Applicable.

BACKGROUND

Technical Field

The present disclosure relates to piecing fabric, and particularly to piecing fabric to produce a quilt.

Description of Related Art

Quilting involves stitching patterns through multiple layers of material. Generally, quilting involves stitching patterns, piece by piece, through the material to produce a quilted pattern. For example, conventional means for piecing a quilt top together involves cutting individual fabric pieces, arranging the pieces, then methodically stitching the cut pieces of fabric to each other. Once the quilt top is fully sewn together, it is layered with other materials and stitched together to complete the quilt. However, this process of piecing the quilt top can be time-intensive and involve advanced stitching skill levels. Therefore, a need exists for methods and materials to simplify and speed up the piecing process.

BRIEF SUMMARY

Novel aspects of the present disclosure are directed to a fabric for creating a quilt top. In a non-limiting embodiment, the fabric includes a design pattern disposed on a first surface of the fabric and a guide pattern disposed on the first surface of the fabric. The guide pattern includes one or more sets of markings that define boundaries for the design pattern. The fabric is configured to be folded and sewn along each marking of the one or more sets of markings. Once each fold is sewn, the design pattern is aligned, and the one or more sets of markings are no longer visible on the first surface. The one or more sets of markings can be disposed on the first surface in a vertical orientation, a horizontal orientation, or a diagonal orientation.

In one aspect, the fabric may include a first set of markings disposed in a first diagonal orientation on the first surface and a second set of markings disposed in a second diagonal orientation on the first surface. The fabric may also include a third set of markings disposed in a vertical orientation on the first surface and a fourth set of markings disposed in a horizontal orientation on the first surface.

In another aspect, the fabric may include a first set of markings that are disposed in a vertical orientation on the first surface a second set of markings that are disposed in a horizontal orientation on the first surface. The fabric may also include a third set of markings that are disposed in a diagonal orientation on the first surface. Each side of the fabric may include an offset at each marking of the first and second set of markings. Each offset can be ¼th of an inch.

Novel aspects of the present disclosure are also directed to a method of texturing fabric to produce a quilt. The method includes folding down a first surface of the fabric top along a marking of a first set of markings to produce a fold and sewing a seam along the fold. The folding and sewing steps are repeated for each marking of the first set of markings. After folding and sewing each marking of the first set of markings, the method can include cutting a portion of each fold where the seam associated with the first set of markings intersects with the other set of markings. Alternatively, the step of cutting a portion of each fold may be performed before the repeating steps.

The method may also include folding down the first surface the fabric top along a marking of a second set of markings to produce a fold and sewing a seam along the fold associated with the second set of markings. The folding and sewing steps are repeated for each marking of the second set of markings. After sewing a seam along the fold associated with the first set of markings, the method may further include unfolding the fold and ironing the seam. After sewing a seam along the fold associated with the second set of markings, the method may also include unfolding the fold and ironing the seam. The unfolding and ironing steps are also repeated with the folding and sewing steps. After completing the steps associated with the second set of markings, the method may include sandwiching the fabric with one or more materials to produce a quilt.

The fold may be ironed after folding down the first surface of the fabric top along a marking of a first set of markings. Similarly, after folding down the first surface the fabric top along a marking of a second set of markings, the fold may be ironed.

The method can include performing the sewing steps with a sewing machine, optionally setting the sewing machine to a stitch length between about 1.5 mm to about 4.0 mm. The sewing steps can further include sewing about a ⅛th inch seam. The sewing steps may include using a 40-weight or 50-weight cotton thread.

The method may also include, before folding down the first surface, washing the fabric with a phosphate-free detergent on a cold-delicate cycle. After washing, drying the fabric with low or medium heat and removing wrinkles in the fabric via ironing a second surface of the fabric. The step of removing the wrinkles is preferably performed free of starch spray.

Novel aspects of the present disclosure are also directed to a method manufacturing a material to be textured. The method includes selecting a design pattern having a plurality of designs and disposing the design pattern on a first surface of the material. The method may also include disposing a guide pattern on the first surface of the material, with the guide pattern defining the plurality of design. The method configures the material to be folded and fastened on the guide pattern to produce a fabric free of the guide pattern on the first surface.

In one embodiment, the method can include disposing a first set of markings in a vertical orientation and disposing a second set of markings in a horizontal orientation. The method may also include disposing a third set of markings in a diagonal orientation and disposing a fourth set of markings in a diagonal orientation opposing the third set of markings.

In another embodiment, the method can include disposing a first set of markings in a first diagonal orientation and disposing a second set of markings in a second diagonal orientation.

In yet another embodiment, disposing the design pattern can comprise forming a series of offsets along each edge of the material, with the offsets being about ¼th of an inch.

BRIEF DESCRIPTION OF THE DRAWINGS

The preceding aspects and many of the attendant advantages of the present technology will become more readily appreciated by reference to the following Detailed Description when taken in conjunction with the accompanying simplified drawings of example embodiments. The drawings briefly described below are presented for ease of explanation and do not limit the scope of the claimed subject matter.

DETAILED DESCRIPTION

Figure 1:
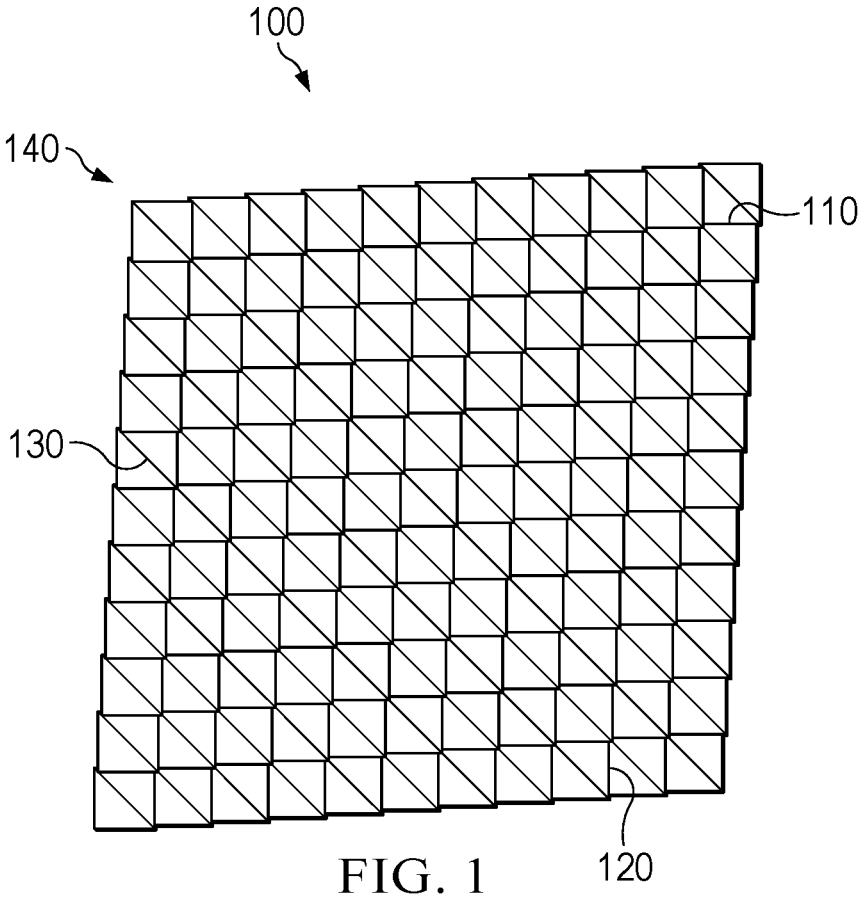
FIG. 1 depicts an embodiment of a fabric having a guide pattern for creating a quilt.

FIG. 1 depicts an embodiment of fabric 100 for creating a quilt. In the illustrated embodiment, fabric 100 includes a first set of markings 110, a second set of markings 120, and a third set of markings 130, which are disposed on a first surface (e.g., top surface) of the fabric 100. Fabric 100 also includes a design pattern (not illustrated) that is disposed on the first surface of the fabric. The design pattern may include various colors and/or ornamentations. In a non-limiting example, the design pattern may include alternating colors and patterns.

The first set of markings 110 are disposed in a horizontal orientation, the second set of markings 120 are disposed in a vertical orientation, and the third set of markings 130 are disposed in a diagonal orientation. The sets of markings (110, 120, 130) may include different colors and/or designs. In a non-limiting example, sets of markings (110, 120, 130) can be red, blue, black, or green. Additionally, or alternatively, the sets of markings (110, 120, 130) can be dashed lines, dotted lines, solid lines, or dot-dash lines.

The sets of markings (110, 120, 130) create a series of boundaries (here, triangular boundaries) that define the patterns of the design pattern. The fabric 100 is configured to be folded and sewn along each set of markings (110, 120, 130), which aligns the patterns of the design pattern and removes the sets of markings (110, 120, 130) from view on the first surface of the fabric 100.

As depicted in the illustrative embodiment, fabric 100 also includes a series of offsets 140 along each edge of the fabric. The offsets 140 on a first edge and a second edge (e.g., top and bottom edges) begin at each marking of the first set of markings 110 that abut the first and second edges. Similarly, the offsets 140 on a third edge and a fourth edge (e.g., left and right edges) begin at each marking of the second set of markings that abut 120 the third and fourth edge. The offsets are preferably ¼th of an inch, although the offsets 140 may be larger or smaller. As explained further herein, the offsets 140 provide an advantage of assuring that the designs of the design pattern align after folding and sewing fabric 100.

Fabric 100 is prepared by fastening each marking of each set of markings (110, 120, 130). In one non-limiting example, fabric 100 is prepared by folding and sewing each marking of the first set of markings 110, beginning from the top or the bottom. After completing the first set of markings, each marking of the second set of markings 120 is similarly folded and sewed, beginning from the left or the right. After completing the second set of marking 120, each marking of the third set of markings 130 is similarly folded and sewed, beginning from the top right corner or the bottom left corner. The order of folding and sewing the sets of markings (110, 120, 130) can vary, but each set should be completed before starting on a different section. Each fold is sewn a distance (preferably ⅛th of an inch) from the edge of the fold, removing ¼th of an inch (⅛th of an inch of the front and ⅛th of an inch on the back). Thus, the ¼-inch offset compensates for each fold and stitch, producing a final textured (or pieced) fabric with aligned designs and hidden markings.

Figure 2:
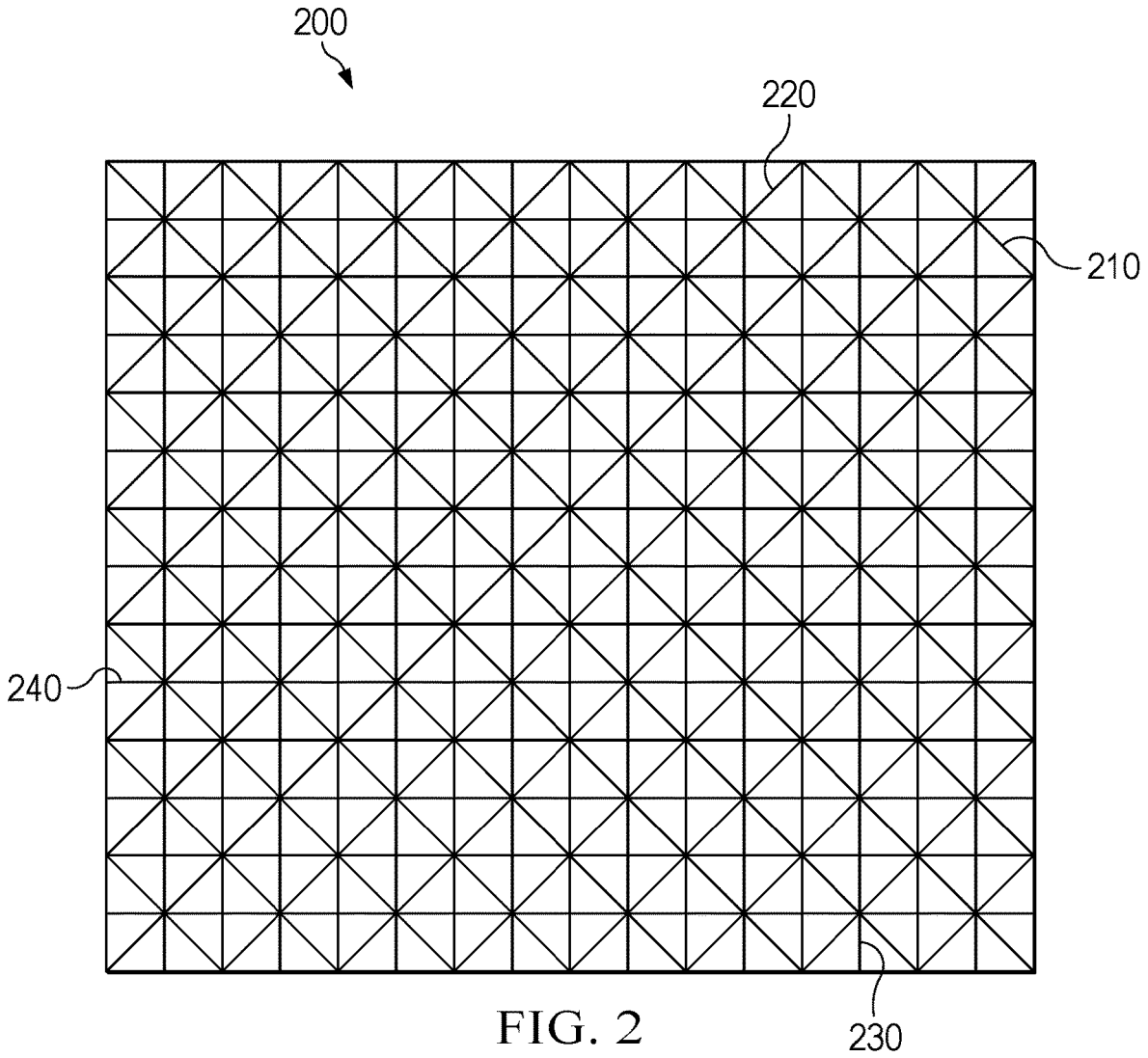
FIG. 2 depicts an alternate embodiment of a fabric having a guide pattern for creating a quilt.

Turning to FIG. 2, an alternate embodiment of fabric 200 for quilting is illustrated. Fabric 200 includes a first set of markings 210, a second set of markings 220, a third set of markings 230, and a fourth set of markings 240, which are disposed on a first surface (e.g., top surface) of the fabric 200. Fabric 200 also includes a design pattern (not illustrated) that is disposed on the first surface of the fabric. The design pattern may include various colors and/or ornamentations. In a non-limiting example, the design pattern may include alternating colors and patterns.

The first set of markings 210 are disposed in a first diagonal orientation, the second set of markings 220 are disposed in a second diagonal orientation, the third set of markings 230 are disposed in a vertical orientation, and the fourth set of markings 240 are disposed in a horizontal orientation. The sets of markings (210, 220, 230, 240) may include different colors and/or designs. In a non-limiting example, sets of markings (210, 220, 230, 240) can be red, blue, black, or green. Additionally, or alternatively, the sets of markings (210, 220, 230, 240) can be dashed lines, dotted lines, solid lines, or dot-dash lines.

The sets of markings (210, 220, 230, 240) create a series of boundaries (here, triangular boundaries) that define the patterns of the design pattern. Fabric 200 is configured to be folded and sewn along each set of markings (210, 220, 230, 240), which aligns the patterns of the design pattern and removes the sets of markings (210, 220, 230, 240) from view on the first surface of the fabric 200. Although FIG. 2 does not depict fabric 200 having a series of offsets along each edge of the fabric 200, fabric 200 may be configured to have such offsets.

Fabric 200 is prepared by fastening each marking of each set of markings (210, 220, 230, 240). In one non-limiting example, fabric 200 is prepared by folding and sewing each marking of the first set of markings 210, beginning from the top right corner or the bottom left corner. After completing the first set of markings, each marking of the second set of markings 220 is similarly folded and sewed, beginning from the top left corner or the bottom right corner. After completing the second set of marking 220, each marking of the third set of markings 230 is similarly folded and sewed, beginning from the right or the left. After completing the second set of marking 230, each marking of the third set of markings 240 is similarly folded and sewed, beginning from the top or the bottom.

The order of folding and sewing the sets of markings (210, 220, 230, 240) can vary, but each set should be completed before starting on a different section. Each fold is sewn a distance (preferably ⅛th of an inch) from the edge of the fold, removing ¼th of an inch (⅛th of an inch of the front and ⅛th of an inch on the back). Thus, the ¼-inch offset compensates for each fold and stitch, producing a final textured (or pieced) fabric with aligned designs and hidden markings.

Figure 3:
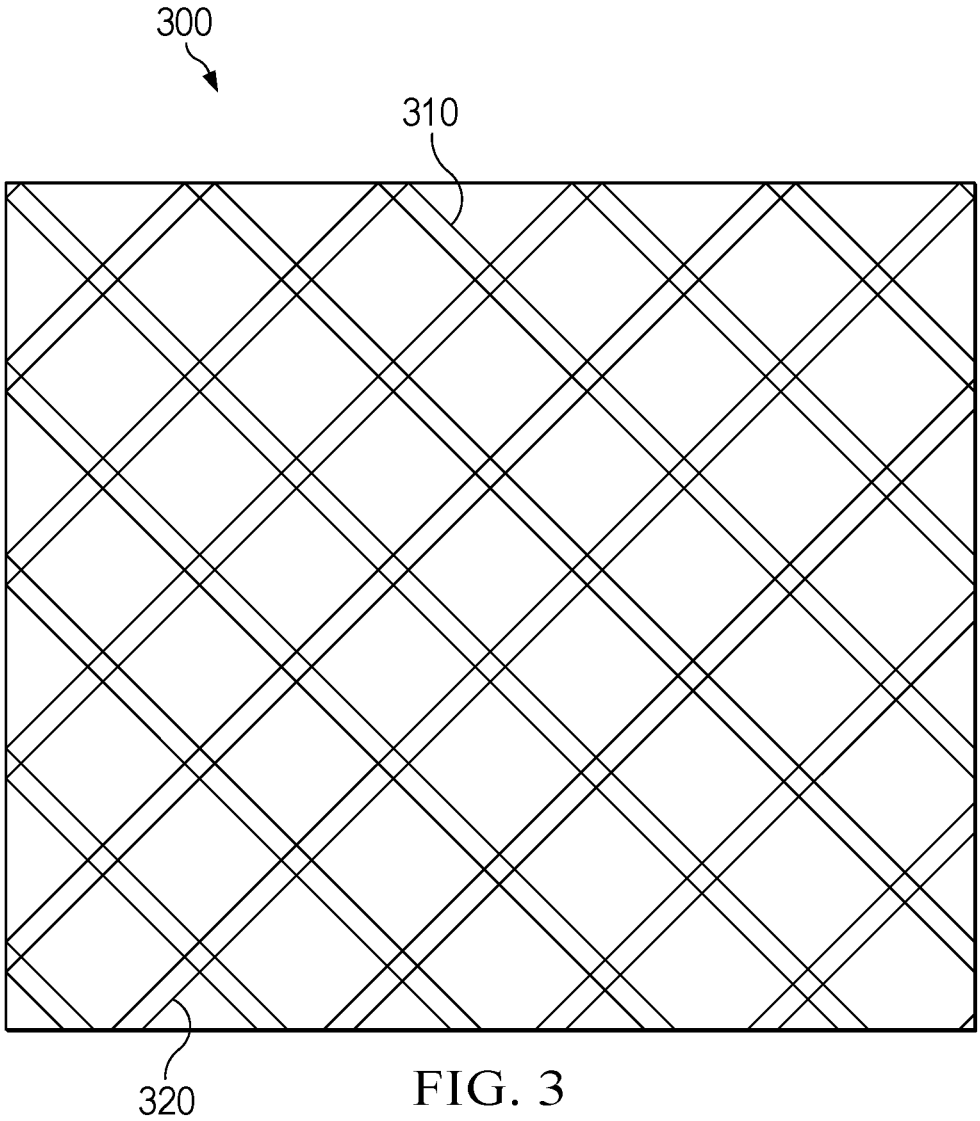
FIG. 3 depicts an alternate embodiment of a fabric having a guide pattern for creating a quilt.

With reference to FIG. 3, an alternate embodiment of fabric 300 for quilting is illustrated. Fabric 300 includes a first set of markings 310 and a second set of markings 320, which are disposed on a first surface (e.g., top surface) of the fabric 300. Fabric 300 also includes a design pattern (not illustrated) that is disposed on the first surface of the fabric.

The design pattern may include various colors and/or ornamentations. In a non-limiting example, the design pattern may include alternating colors and patterns.

The first set of markings 310 are disposed in a first diagonal orientation, and the second set of markings 320 are disposed in a second diagonal orientation. The sets of markings (310, 320) may include different colors and/or designs. In a non-limiting example, sets of markings (310, 320) can be red, blue, black, or green. Additionally, or alternatively, the sets of markings (310, 320) can be dashed lines, dotted lines, solid lines, or dot-dash lines.

The sets of markings (310, 320) create a series of boundaries (here, triangular boundaries) that define the patterns of the design pattern. Fabric 300 is configured to be folded and sewn along each set of markings (310, 320), which aligns the patterns of the design pattern and removes the sets of markings (310, 320) from view on the first surface of the fabric 300. Although FIG. 3 does not depict fabric 300 having a series of offsets along each edge of the fabric 300, fabric 300 may be configured to have such offsets.

Fabric 300 is prepared by fastening each marking of each set of markings (310, 320). In one non-limiting example, fabric 300 is prepared by folding and sewing each marking of the first set of markings 310, beginning from the top right corner or the bottom left corner. After completing the first set of markings, each marking of the second set of markings 320 is similarly folded and sewed, beginning from the top left corner or the bottom right corner.

The order of folding and sewing the sets of markings (310, 320) can vary, but each set should be completed before starting on a different section. Each fold is sewn a distance (preferably ⅛th of an inch) from the edge of the fold, removing ¼th of an inch (⅛th of an inch of the front and ⅛th of an inch on the back). Thus, the ¼-inch offset compensates for each fold and stitch, producing a final textured (or pieced) fabric with aligned designs and hidden markings. The disclosed fabrics provide the advantage of simplifying the piecing process (and speeding it up) by not requiring a user to cut and assemble the pieces on a fabric, as the pieces are already disposed on the fabric.

Piecing a Fabric for a Quilt

Figure 4:
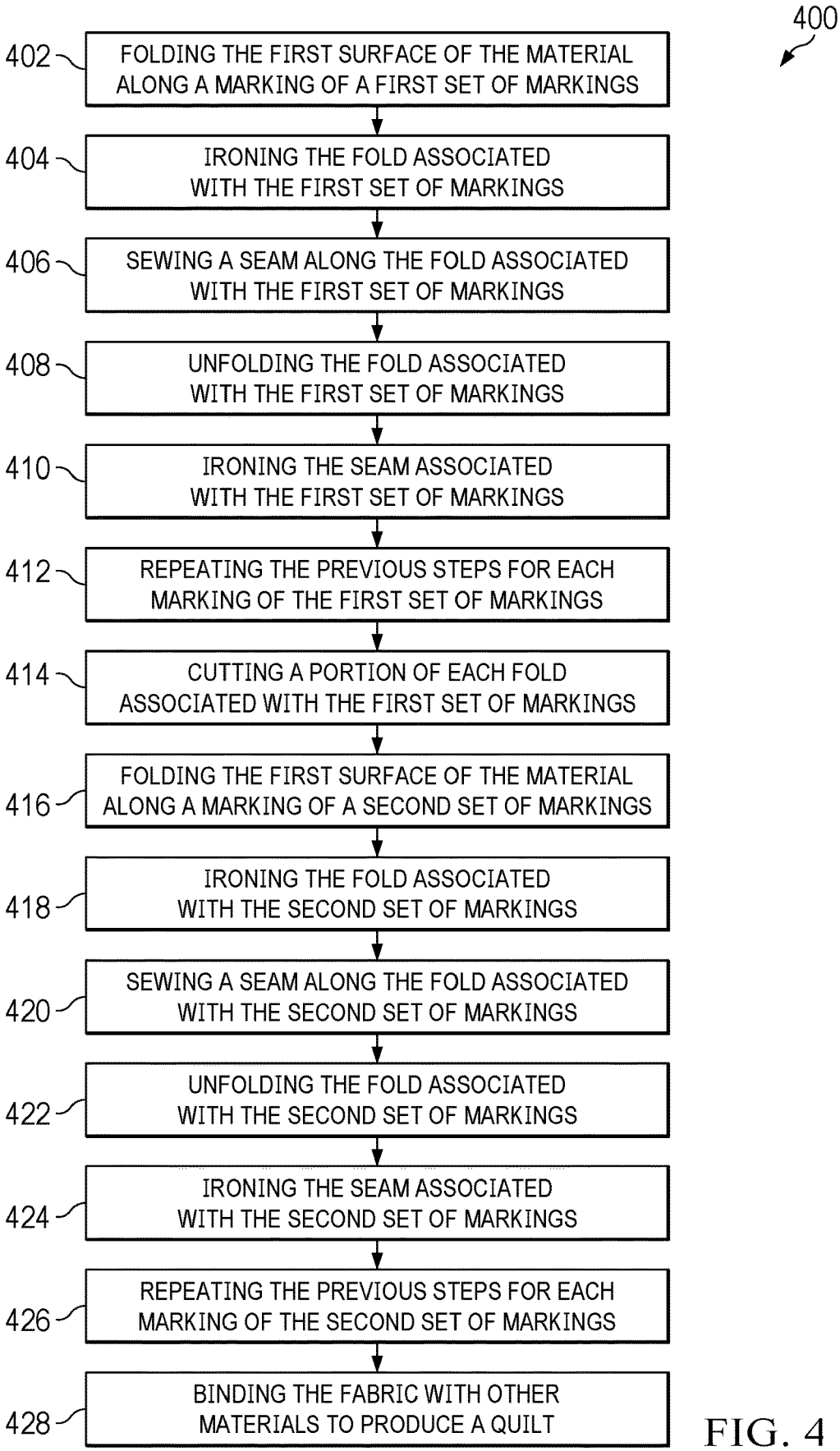
FIG. 4 depicts a flowchart of a method of texturing a piece of fabric to create a quilt.

With reference to FIG. 4, a flowchart 400 of a method of texturing (or piecing) fabric is illustrated. Flowchart 400 begins at step 402 by folding down the first surface of the fabric top along a marking of a first set of markings to produce a fold and exposing the second surface. At step 404, the fold is ironed, and at step 416, a seam is sewn along the fold associated with the first set of markings. The fold is unfolded at step 408, and at step 410, the seam is ironed. During step 410, the fabric is repositioned so that the second face is exposed to iron the seam. The flowchart continues at step 412, where steps 402-410 are repeated for each marking of the first set of markings. At step 414, the flowchart continues by cutting a portion of each sewn fold where the seam intersects with the other sets of markings.

The flowchart continues at step 416 by folding down the first surface the fabric top along a marking of a second set of markings to produce a fold and exposing the second surface. At step 418, the fold is ironed, and at step 420, a seam is sewn along the fold associated with the second set of markings. The seam can be sewn about ⅛th of an inch from the fold. The fold is unfolded at step 422, and at step 424, the seam is ironed. During step 424, the fabric is repositioned so that the second face is exposed to iron the seam. The flowchart continues at step 426, where steps 416-424 are repeated for each marking of the second set of markings. The flowchart optionally continues at step 428, where the textured fabric is bound with other materials (e.g., fabrics) to produce a quilt. The disclosed methods provide the advantage of simplifying the piecing process (and speeding it up) by not requiring a user to cut and assemble the pieces on a fabric.

The method depicted in flowchart 400 can be modified to accommodate more sets of markings. In such embodiments, one of which is described below, steps 402-414 would apply to each set of marks except the last set of marks. For the last set of marks, it is unnecessary to cut the portion of each sewn fold (step 414).

While flowchart 400 depicts cutting the portion of each sewn fold (step 414) after repeating steps 402-410, the method can be modified for step 414 to occur earlier in the method. In a non-limiting example, step 414 could be moved between step 410 and 412, such that cutting occurs after every seam ironing in step 410 (if present).

The seams in steps 406 and 420 can be sewn about ⅛th of an inch from the fold. When utilizing a sewing machine to perform the method described in flowchart 400, a stitch length between about 1.5 mm and about 4.0 mm can be used to sew the seams. The method described in flowchart 400 is preferably performed with a 40-weight or 50-weight cotton thread, although different weights known in the art can be used.

Optionally, prior to step 402, the fabric can be washed, preferably on a cold-delicate cycle and free of phosphate detergent. The fabric can be dried with a low or medium heat setting (e.g., a drying machine). Wrinkles can be removed from the fabric by ironing the second (e.g., bottom) surface of the fabric, preferably free of starch spray.

Exemplar Method for Piecing a Fabric for a Quilt

With reference to FIG. 2, an exemplar method of texturing (or piecing) fabric 200 is described. The method begins by washing fabric 200 on a cold-delicate cycle with a phosphate-free detergent. Any loose threads developed from the washing should be clipped from the sides of fabric 200. The method continues by ironing the top and bottom surfaces of fabric 200, preferably using an iron set on the cotton setting. The ironing step preferably does not include spraying fabric 200 with starch spray. Additionally, or alternatively, wrinkles in fabric 200 may be removed via steam or spray water.

After preparing fabric 200 for texturing, the sewing machine should be prepared. Preferably, the sewing machine is loaded with a 40-weight or 50-weight 100% cotton thread. The color of the thread is preferably white or a color complementary to the colors of the design on fabric 200. Once the bobbin and thread are loaded into the sewing machine, the stitch length is set, preferably to 1.5 mm. Next, the sewing machine should be calibrated to sew a desired seam, preferably a ⅛th inch seam.

The method continues by laying fabric 200 on a surface with the top surface of fabric 200 exposed. Fabric 200 is then folded along the first marking of the first set of markings 210 (i.e., the top right corner of fabric 200), exposing the bottom surface of the folded portion of fabric 200. A ⅛th inch seam is sewn along the fold line, locking the stitch at the seam's beginning and end. Fabric 200 is unfolded and placed face down (i.e., bottom surface exposed) on the surface, and the seam is ironed.

After ironing the seam, fabric 200 is placed on the surface with the top surface of fabric 200 exposed. Fabric 200 is then folded along the second marking of the first set of markings 210 (i.e., towards the bottom left). A ⅛th inch seam is sewn along the fold line, and fabric 200 is unfolded and placed face down on the surface for the seam to be ironed. The steps performed for the second marking are repeated for the remaining markings of the first set of markings 210. Once each marking of the first set of markings 210 is sewn, the first set of markings 210 are no longer visible on the top surface of fabric 200.

After sewing each marking of the first set of markings 210, any stray threads should be clipped. Fabric 200 is placed face down on the surface to iron the seams, opening the seams and producing consistent folds. The method continues by clipping a triangle portion out of the fold where the seam associated with the first set of markings 210 intersects with the second set of markings 220, the third set of markings 230, and the fourth set of markings 240. Clipping the fold in this manner allows the seams to lay in an optimal orientation.

The method continues by laying fabric 200 on the surface with the top surface of fabric 200 exposed. Fabric 200 is then folded along the first marking of the second set of markings 220 (i.e., the top left corner of fabric 200), exposing the bottom surface of the folded portion of fabric 200. A ⅛th inch seam is sewn along the fold line, and fabric 200 is unfolded and placed face down on the surface for the seam to be ironed.

After ironing the seam, fabric 200 is placed on the surface with the top surface of fabric 200 exposed. Fabric 200 is then folded along the second marking of the second set of markings 220 (i.e., towards the bottom right). A ⅛th inch seam is sewn along the fold line, and fabric 200 is unfolded and placed face down on the surface for the seam to be ironed. The steps performed for the second marking are repeated for the remaining markings of the second set of markings 220. Once each marking of the second set of markings 220 is sewn, the second set of markings 220 are no longer visible on the top surface of fabric 200.

After sewing each marking of the second set of markings 220, any stray threads should be clipped. Fabric 200 is placed face down on the surface to iron the seams, opening the seams and producing consistent folds. The method continues by clipping a rectangle portion out of the fold where the seam associated with the second set of markings 220 intersects with the third set of markings 230 and the fourth set of markings 240.

The method continues by laying fabric 200 on the surface with the top surface of fabric 200 exposed. Fabric 200 is then folded along the first marking of the third set of markings 230 (i.e., the right side of fabric 200), exposing the bottom surface of the folded portion of fabric 200. A ⅛th inch seam is sewn along the fold line, and fabric 200 is unfolded and placed face down on the surface for the seam to be ironed.

After ironing the seam, fabric 200 is placed on the surface with the top surface of fabric 200 exposed. Fabric 200 is then folded along the second marking of the third set of markings 230 (i.e., towards the left). A ⅛th inch seam is sewn along the fold line, and fabric 200 is unfolded and placed face down on the surface for the seam to be ironed. The steps performed for the second marking are repeated for the remaining markings of the third set of markings 230. Once each marking of the third set of markings 230 is sewn, the third set of markings 230 are no longer visible on the top surface of fabric 200.

After sewing each marking of the third set of markings 230, any stray threads should be clipped. Fabric 200 is placed face down on the surface to iron the seams, opening the seams and producing consistent folds. The method continues by clipping a triangle portion out of the fold where the seam associated with the third set of markings 230 intersects with the fourth set of markings 240.

The method continues by laying fabric 200 on the surface with the top surface of fabric 200 exposed. Fabric 200 is then folded along the first marking of the fourth set of markings 240 (i.e., the top side of fabric 200), exposing the bottom surface of the folded portion of fabric 200. A ⅛th inch seam is sewn along the fold line, and fabric 200 is unfolded and placed face down on the surface for the seam to be ironed.

After ironing the seam, fabric 200 is placed on the surface with the top surface of fabric 200 exposed. Fabric 200 is then folded along the second marking of the fourth set of markings 240 (i.e., towards the bottom). A ⅛th inch seam is sewn along the fold line, and fabric 200 is unfolded and placed face down on the surface for the seam to be ironed. The steps performed for the second marking are repeated for the remaining markings of the fourth set of markings 240. Once each marking of the fourth set of markings 240 is sewn, the fourth set of markings 240 are no longer visible on the top surface of fabric 200.

After sewing each marking of the third set of markings 230, any stray threads should be clipped. Fabric 200 is placed face down on the surface to iron the seams, opening the seams and producing consistent folds. After placing fabric 200 on the surface with the top surface exposed, the design pattern is properly aligned and outlined by the seams, producing a quilted pattern.

After sewing each marking of the sets of markings (210, 220, 230, 240), the fabric is completely pieced and ready to be sandwiched (or basted) with other materials (e.g., fabrics) to produce a quilt.

Example Method of Manufacturing a Fabric for Piecing

With reference to FIG. 1, a method of manufacturing a fabric 100 to be textured (or pieced) is described. The method begins by selecting a design pattern comprising a plurality of designs. The plurality of designs can include six solid patterns of different colors and twelve ornamental patterns having different shapes. The method continues by disposing the design pattern on a top surface of the material and disposing a guide pattern on the top side of the material. The guide pattern de-fines the plurality of design. The method configures the fabric to be folded and fastened on the guide pattern to produce a fabric that is free of the guide pattern on the top surface. The step of disposing the design pattern can include forming a series of offsets along each edge of the material, with the offsets being ¼th of an inch.

In one embodiment, the step of disposing the guide pattern can include disposing a first set of markings in a vertical orientation and disposing a second set of markings in a horizontal orientation. The step of disposing the guide pattern can further include disposing a third set of markings in a diagonal orientation. The step of disposing the guide pattern can further include disposing a fourth set of markings in a diagonal orientation opposing the third set of markings.

In an alternative embodiment, the step of disposing the guide pattern can include disposing a first set of markings in a first diagonal orientation and disposing a second set of markings in a second diagonal orientation.

All numeric values herein are assumed to be modified by the term "about," whether explicitly indicated. For the purposes of the present invention, ranges may be expressed as from "about" one particular value to "about" another particular value. It will be understood that the endpoints of each of the ranges are significant both concerning the other endpoint and independently of the other endpoint. When a value is expressed as an approximation by use of the antecedent "about," it will be understood that the particular value forms another embodiment.

Moreover, for the purposes of the present disclosure, the term "a" or "an" entity refers to one or more of that entity. As such, the terms "a" or "an," "one or more," and "at least one" can be used interchangeably herein.

Additionally, the section headings herein are provided for consistency with the suggestions under 37 C.F.R. § 1.77 or to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that a particular technology is prior art to any embodiment(s) in this disclosure. Neither is the "Summary" a characterization of the embodiment(s) outlined in issued claims.

Furthermore, any reference in this disclosure to "invention" in the singular should not be used to argue that there is only a single point of novelty in this disclosure. Multiple embodiments may be set forth according to the limitations of the multiple claims issued from this disclosure. Such claims accordingly define the embodiment(s) and their equivalents that are protected thereby. In all instances, the scope of such claims shall be considered on their own merits in light of this disclosure but should not be constrained by the headings set forth herein.

Moreover, the Abstract is provided to comply with 37 C.F.R. § 1.72 (b), requiring an abstract that will allow the reader to ascertain the nature of the technical disclosure quickly. It is submitted with the understanding that it will not be used to interpret or limit the scope or meaning of the claims. In addition, in the preceding Detailed Description, it can be seen that various features may be grouped in a single embodiment to streamline the disclosure. This method of disclosure is not to be interpreted as reflecting an intention that the claimed embodiments require more features than are expressly recited in each claim. Instead, as the claims reflect, the inventive subject matter lies in less than all features of a single disclosed embodiment. Thus, the following claims are incorporated into the Detailed Description, with each claim standing on its own as a separate embodiment.

What is claimed is:

1. A fabric for piecing a portion of a quilt, the fabric comprising:

a design pattern disposed on a first surface of the fabric, and a foldable guide pattern disposed on the first surface of the fabric, the guide pattern comprising a first set of generally parallel markings and a second set of generally parallel markings which are generally perpendicular to the first set of markings, wherein the first and second sets of markings define a generally rectilinear area for placement of the design pattern;

wherein the fabric is configured to be folded along at least one of a chosen marking to create a boundary, and then sewn along that boundary so that at least one marking is no longer visible on the first surface.

2. The fabric of claim 1, wherein the sets of markings are disposed on the first surface in a vertical orientation, a horizontal orientation, or a diagonal orientation.

3. The fabric of claim 2, wherein the first set of markings are disposed in a first diagonal orientation on the first surface, and further wherein the second set of markings are disposed in a second diagonal orientation on the first surface.

4. The fabric of claim 3, further comprising a third set of markings disposed in a vertical orientation on the first surface and a fourth set of markings are disposed in a horizontal orientation on the first surface.

5. The fabric of claim 2, wherein the first set of markings are disposed in a vertical orientation on the first surface, and further wherein the second set of markings are disposed in a horizontal orientation on the first surface.

6. The fabric of claim 5, further comprising a third set of markings disposed in a diagonal orientation on the first surface, and further wherein each side of the fabric comprises an offset at each marking of the first and second set of markings, further wherein each offset is ¼th of an inch.

7. The fabric of claim 1, wherein the first set of markings intersect with the second set of markings.

8. A fabric for piecing a portion of a quilt, the fabric comprising:

a design pattern disposed on a first surface of the fabric;

a foldable guide pattern disposed on the first surface of the fabric, the guide pattern comprising a first set of generally parallel markings and a second set of generally parallel markings which are generally perpendicular to the first set of markings, wherein the first and second sets of markings define a generally rectilinear area for placement of the design pattern, further wherein the first set of markings intersect with the second set of markings; and wherein the fabric is configured to be folded along at least one of a chosen marking to create a boundary, and then sewn along that boundary so that at least one marking is no longer visible on the first surface.

9. The fabric of claim 8, wherein the first set of markings are disposed in a first diagonal orientation on the first surface, and further wherein the second set of markings are disposed in a second diagonal orientation on the first surface.

10. The fabric of claim 8, wherein the first set of markings are disposed in a vertical orientation on the first surface, and further wherein the second set of markings are disposed in a horizontal orientation on the first surface.

11. The fabric of claim 8, wherein each side of the fabric comprises an offset at each marking of the first and second set of markings.

12. The fabric of claim 11, wherein each offset is ¼th of an inch.

* * * * *